US006672211B2

(12) United States Patent
Price et al.

(10) Patent No.: US 6,672,211 B2
(45) Date of Patent: Jan. 6, 2004

(54) INKING SYSTEMS FOR PRINTING PRESSES

(75) Inventors: James F. Price, 1305 Johns Dr., Euless, TX (US) 76039-2628; Robert L. Goodman, Mesquite, TX (US); William A. Sullivan, Irving, TX (US)

(73) Assignee: James F. Price, Euless, TX (US)

( * ) Notice: Subject to any disclaimer, the term of this patent is extended or adjusted under 35 U.S.C. 154(b) by 0 days.

(21) Appl. No.: 09/813,887

(22) Filed: Mar. 22, 2001

(65) Prior Publication Data

US 2001/0032559 A1 Oct. 25, 2001

Related U.S. Application Data

(63) Continuation-in-part of application No. 09/507,549, filed on Feb. 18, 2000.

(60) Provisional application No. 60/122,765, filed on Mar. 3, 1999.

(51) Int. Cl.[7] ..... B41F 31/00

(52) U.S. Cl. ..... 101/483; 101/148; 101/340.4; 101/177

(58) Field of Search ..... 101/350.1, 350.4, 101/350.5, 350.6, 351.7, 352.04, 352.11, 364, 365, 366, 367, 425, 423, 375, 148, 247, 177, 248, 483

(56) References Cited

U.S. PATENT DOCUMENTS

| | | | | |
|---|---|---|---|---|
| 2,285,052 A | | 6/1942 | Roesen | |
| 2,613,600 A | | 10/1952 | McWhorter | |
| 2,986,088 A | * | 5/1961 | Chase et al. | 101/350.5 |
| 3,504,626 A | | 4/1970 | Worthington | |
| 3,587,463 A | | 6/1971 | Granger | |
| 3,611,924 A | * | 10/1971 | Harrison | 101/352.01 |
| 3,800,702 A | | 4/1974 | Roberts | |
| 4,040,348 A | | 8/1977 | Gertsch et al. | |
| 4,041,864 A | * | 8/1977 | Dahlgren et al. | 101/367 |
| 4,254,709 A | | 3/1981 | Arnolds | |
| 4,263,848 A | | 4/1981 | Matalia et al. | |
| 4,373,442 A | | 2/1983 | Dahlgren et al. | |
| 4,428,288 A | * | 1/1984 | Harper et al. | 101/248 |
| 4,428,291 A | | 1/1984 | Dorow | |
| 4,453,463 A | * | 6/1984 | Dahlgren et al. | 101/148 |
| 4,493,257 A | | 1/1985 | Kubert et al. | |
| 4,527,471 A | | 7/1985 | Dahlgren et al. | |

(List continued on next page.)

FOREIGN PATENT DOCUMENTS

| | | |
|---|---|---|
| DE | 11 30 453 | 5/1962 |
| DE | 44 24 581 | 10/1995 |
| JP | 61 106254 | 5/1986 |
| WO | 83/04003 | 11/1983 |
| WO | 00 51817 | 9/2000 |

OTHER PUBLICATIONS

J. W. Freeman; Letter re: United States patent application 2001/0032559, Oct. 25, 1991 "Iinking Systems for Printing Presses"; letter dated Jan. 10, 2003; 4 pages of letter and 8 pages of enclosure bearing dates in Aug., 1995.

Karat Digitial Press, Product Overview, The Next Tradition in Printing, (Karat Digital Press L.P.).

*Primary Examiner*—Eugene H. Eickholt

(57) ABSTRACT

A printing system is disclosed including an inking system with a single form roller for applying ink to a printing cylinder. Ink is applied to the form roller by an applicator roller having a surface with an array of interconnected wells and a variable speed drive. The form roller and plate cylinder are rotated at the same rpm while the speed of the applicator roller is varied to vary the amount of ink applied to the plate. A variable speed subtractive roller system removes excess ink from the form roller and returns the ink to a common reservoir. For wash-up, the press drive and form roller are disengaged and the inking system is rotated by an inker roller drive while wash-up fluid is applied to the inking system.

18 Claims, 12 Drawing Sheets

U.S. PATENT DOCUMENTS 4,527,479 A 7/1985 Dahlgren et al.
4,542,693 A * 9/1985 Mourrellone ..... 101/350.4
4,621,574 A * 11/1986 Faddis et al. ..... 101/350.3
4,685,414 A 8/1987 DiRico
4,864,925 A 9/1989 Van Kanegan et al.
4,967,657 A * 11/1990 Popkin ..... 101/148
5,033,380 A 7/1991 Sonobe et al.
5,046,416 A * 9/1991 Freyer et al. ..... 101/425
5,178,065 A 1/1993 Reder et al.
5,178,678 A 1/1993 Koehler et al.
5,218,905 A 6/1993 Bolte et al.
5,243,910 A * 9/1993 Burch ..... 101/425
5,259,313 A 11/1993 Gibson et al.
5,297,488 A * 3/1994 Bunch, Jr. ..... 101/247
5,315,930 A 5/1994 Niemiro
5,355,796 A 10/1994 Köbler et al.
5,355,799 A 10/1994 Lutz
5,425,809 A * 6/1995 Person ..... 101/154
5,452,660 A 9/1995 Stein
5,603,262 A * 2/1997 Uera et al. ..... 101/350.5
5,709,147 A 1/1998 Uera et al.
5,865,116 A * 2/1999 Keller ..... 101/148
5,908,505 A 6/1999 Bargenquest et al.
5,983,799 A * 11/1999 Lane, III et al. ..... 101/375
6,006,664 A * 12/1999 Hummel et al. ..... 101/350.4
6,006,665 A * 12/1999 Stuchlik et al. ..... 101/375
6,041,706 A * 3/2000 Murray ..... 101/350.1
6,055,907 A * 5/2000 Endisch et al. ..... 101/425
6,065,402 A 5/2000 Feller et al.
6,116,161 A * 9/2000 Voge et al. ..... 101/423
6,382,098 B2 * 5/2002 Inoue et al. ..... 101/177
6,409,645 B1 * 6/2002 Paasonen et al. ..... 101/375

* cited by examiner

INKING SYSTEMS FOR PRINTING PRESSES

CROSS-REFERENCE TO RELATED APPLICATIONS

This application is a continuation-in-part of U.S. application Ser. No. 09/507,549 filed Feb. 18, 2000, which claims the benefit of U.S. Provisional Patent Application No. 60/122,765 filed on Mar. 3, 1999. application Ser. No. 09/507,549 is hereby incorporated by reference in its entirety.

FIELD OF THE INVENTION

The field of the invention is printing presses, and more particularly, inking systems for printing presses.

BACKGROUND OF THE INVENTION

An offset printing press typically includes a plate cylinder carrying one or more printing plates. The printing plates have oleophilic surfaces defining an image area, and hydrophilic surfaces defining a non-image area. An inker applies ink to the printing plate which collects on the oleophilic surfaces to form an image which can be transferred to a blanket cylinder which transfers the image to media. By transferring the image from the printing plate onto a blanket roller, and then onto the media, the printing plate does not directly print the image on the media, hence the term offset printing.

The inker applies ink carried on one or more form rollers to the printing plate. When the form roller in the inker engages the printing plate, the ink film on the form roller contacting image areas on the printing plate is split such that approximately one-half of the thickness of the ink film is applied to the image area of the printing plate leaving approximately one-half the ink on the form roller causing a condition referred to as starvation. The ink film on the form roller contacting non-image areas on the printing plate remains on the form roller causing a condition called accumulation.

This combination of accumulation and starvation results in undesirable "ghosted" images and image repeats being formed on the final printed product. In order to minimize this problem, conventional inkers include a plurality of form rollers which each apply a small amount.

The printed product is monitored to determine when ink density has degraded beyond an acceptable level. In order to control the quality of the printing, conventional printer inkers also include a plurality of adjustable keys to control the amount of ink being applied to the form roller. These keys require constant adjustment to maintain the quality of the printed product.

One attempt to provide a keyless inker incorporated a reverse rotating roller in pressural indentation contact with a main form roller to meter the ink and erase the previous image on the form roller. This prior art inker provided an even film of ink on the printing plate, and inhibited the accumulation and starvation of ink on the form roller. This reverse roller imposed a counter rotating force to the main form roller which increased the power requirements for operating the printing press. In addition the friction caused by the counter-rotating roller generated a tremendous amount of heat that had to be "taken away", resulting in more horse power and satellite refrigeration equipment at each printing assembly.

In U.S. Pat. No. 4,453,463, an inker is disclosed for a lithographic printing press in which dampening fluid is applied to a resilient form roller. A blade is mounted to remove the dampening fluid and excess ink directly from the resilient form roller surface. The form roller is rotated into the leading edge of the doctor blade, which is pressure indented to the form roller, and increases the power requirements for rotating the form roller. Furthermore, the blade has a tendency to damage the form roller resilient surface.

U.S. Pat. No. 4,527,479 discloses a method and apparatus for continuously using ink and dampening fluid in a printing system which includes removing ink and dampening fluid from a form roller after the form roller engages the printing plate. Unused printing ink and dampening fluid is removed from the form roller by an idler roller, and a scraping off means scrapes the mixture directly from the idler roller. The mixture is then returned to the reservoir. The ink and dampening fluid removed from the form roller are blended in the reservoir with fresh ink, and recirculated to a distributor line for application to the form roller. This concept works well for a printing press using a low viscosity news print ink which does not dry quickly onto a continuous media. However, for high quality multi colored sheet fed products, the circulation of ink and wash-up requirements is prohibitive.

Another attempt to solve the problem of ghosting is disclosed in U.S. Pat. No. 5,315,930 entitled "KEYLESS INKING SYSTEM FOR A PRINTING PRESS". This patent discloses an inking system for a printing press having an ink injector for supplying ink under pressure, and a device for pumping and metering the ink flow in the injector. The ink injector supplies ink to a fountain roller having an outer brush surface. The fountain roller applies the ink to a pick up roller which transfers the ink through a series of rollers to an applicator roller. The applicator roller has a resilient surface, and applies the ink to two form rollers. A scraper roller engages the applicator roller to remove excess ink therefrom. A scraper blade scrapes ink from the scraper roller. Ink scraped from the scraper roller is transported to an ink reservoir, and is then recirculated using a pump to the ink injector. The inking system in U.S. Pat. No. 5,315,930 has multiple form rollers, and does not provide any means for removing excess ink from the form rollers. In addition, the inking system requires ink recirculation which requires a lengthy wash-up time.

All of the patents referred to above have sought to solve "ghosting", starvation, and accumulation problems in inking systems. However, the solutions have complicated the printing press assemblies, require circulating the ink which complicates washing the inker for a color change, and can cause damage to the single form roller.

OBJECTS OF THE INVENTION

It is an object of the present invention to provide an inking system which reduces or eliminates "ghosting", repeat, starvation and accumulation problems normally associated with prior inking systems.

It is another object of the present invention to provide a relatively uncomplicated inking apparatus which provides uniform inking.

It is another object of the present invention to provide an effective inker having a single form roller for applying a uniform film of ink on a printing plate.

It is another object of the present invention to provide an inking system having effective control of the ink so that it is applied uniformly across the plate two-dimensionally.

It is another object of the present invention to provide an inking system in which wash-up may be efficiently accomplished with minimal use of wash-up fluids or solvents.

It is another object of the present invention to provide an inker that does not require ink circulation to simplify wash-up when changing ink colors.

It is another object of the present invention to provide an inking system having effective control of the ink film applied uniformly across the plate by varying the speed of the ink applicator roller.

It is another object of the present invention to provide an inking system having effective control of the ink being removed from the surface of the form roller.

It is another object of the present invention to provide an inking system in which wash-up may be efficiently accomplished without press assist. The ink applicator and subtractive roll motors provide the inker rotation for wash-up.

These and other objects and features will be apparent from the written description and drawings contained herein.

SUMMARY OF THE INVENTION

The invention disclosed herein provides a printing press having a keyless inking system. A conventional key adjusted inking system is an attempt to solve a two dimensional ink distribution problem with a one-dimensional control system (i.e. a row of keys arranged along the width of the press). The present invention controls the two dimensional ink distribution on the surface of a single form roller which inks the printing plate(s).

The inking system of the present invention employs a form roller for applying ink to a printing plate, and a transfer roller adjacent the form roller for removing excess ink from the form roller after printing. A subtractive roller adjacent the transfer roller removes excess ink from the transfer roller, and a scraper blade adjacent the subtractive roller scrapes excess ink from said subtractive roller. An ink reservoir adjacent the scraper blade receives ink scraped from the subtractive roller, and supplies ink for application onto the form roller. An applicator roller adjacent the ink reservoir receives ink from the ink reservoir, and applies the ink to the form roller.

The scraper blade and doctor blade are preferably mounted in a common blade holder which is movable for simultaneously positioning the scraper blade in engagement with the smooth-surfaced ink subtractive roller and the doctor blade in engagement with the surface of the applicator roller. Space between the scraper blade and the doctor blade forms an ink fountain which receives ink from the subtractive roller and applies ink to the applicator roller. Thus, an inker is provided which has an ink reservoir interposed between a subtractive roller which deposits excess ink from the form roller therein, and an applicator roller which receives ink from the ink reservoir for application onto the form roller.

Embodiments of the present invention include a printing system having a rotating plate cylinder carrying a printing plate and a single form roller for applying ink to the printing plate. In accordance with this aspect of the invention the plate cylinder and the form roller are rotated at the same rpm so that the same areas on the form roller contact the same areas on the printing plate during each revolution of the plate cylinder. The plate cylinder and the form roller are configured to have different diameters and, thus, have different surface speeds at a nip formed there between. The system may be equipped with the keyless, subtractive inking system described above. In operation the system is capable of producing an ink film on the two-dimensional surface of the single form roller which essentially eliminates ghosting, repeats, accumulation and starvation. Through simple speed adjustments of the applicator roller, an essentially uniform film of ink may be applied to the image areas of the printing plate. Repeats and ghostings caused by a lack of registration between surfaces of the printing plate and the form roller are eliminated.

In preferred embodiments of the printing system of the present invention, the form roller is of similar size to the plate cylinder. The form roller may be constructed with a removable covering to facilitate maintenance procedures and to reduce the need to remove the relatively large form roller from the press.

In another preferred embodiment of the present invention, the applicator roller has a hard surface formed with an array of wells, adjacent ones of which are interconnected by at least one channel. A doctor blade, which forms part of the ink reservoir, meters ink from the ink reservoir onto the applicator roller. The amount of ink applied to the form roller and then to the printing plate may be adjusted by adjusting the speed of the applicator roller relative to the press speed.

Preferred embodiments of the printing system of the present invention are designed to facilitate efficient and effective ink wash-up. These systems may include mechanisms for disengaging the press drive from the inker and for separately driving the inking system during wash-up. One or more spray bars may be used for applying wash-up fluid to at least one roller in the inking system. In operation the ink subtractive roller may be used to remove a mixture of wash-up fluid and residual ink from the inker system and deposit the mixture into a wash common reservoir during wash-up.

The foregoing is intended to provide a convenient summary of the present disclosure. However, the invention intended to be protected is set forth in the claims hereof.

DESCRIPTION OF THE DRAWINGS

Drawings of preferred embodiments of the invention are annexed hereto so that the invention may be better and more fully understood.

FIG. 6(*a*) is a detail of FIG. 6;

FIG. 11(*a*) is a detail of FIG. 11 showing the surface structure of a roller depicted in FIG. 11.

Numeral references are employed to designate like parts or aspects throughout the various figures of the drawings.

DESCRIPTION OF PREFERRED EMBODIMENTS

Figure 1:
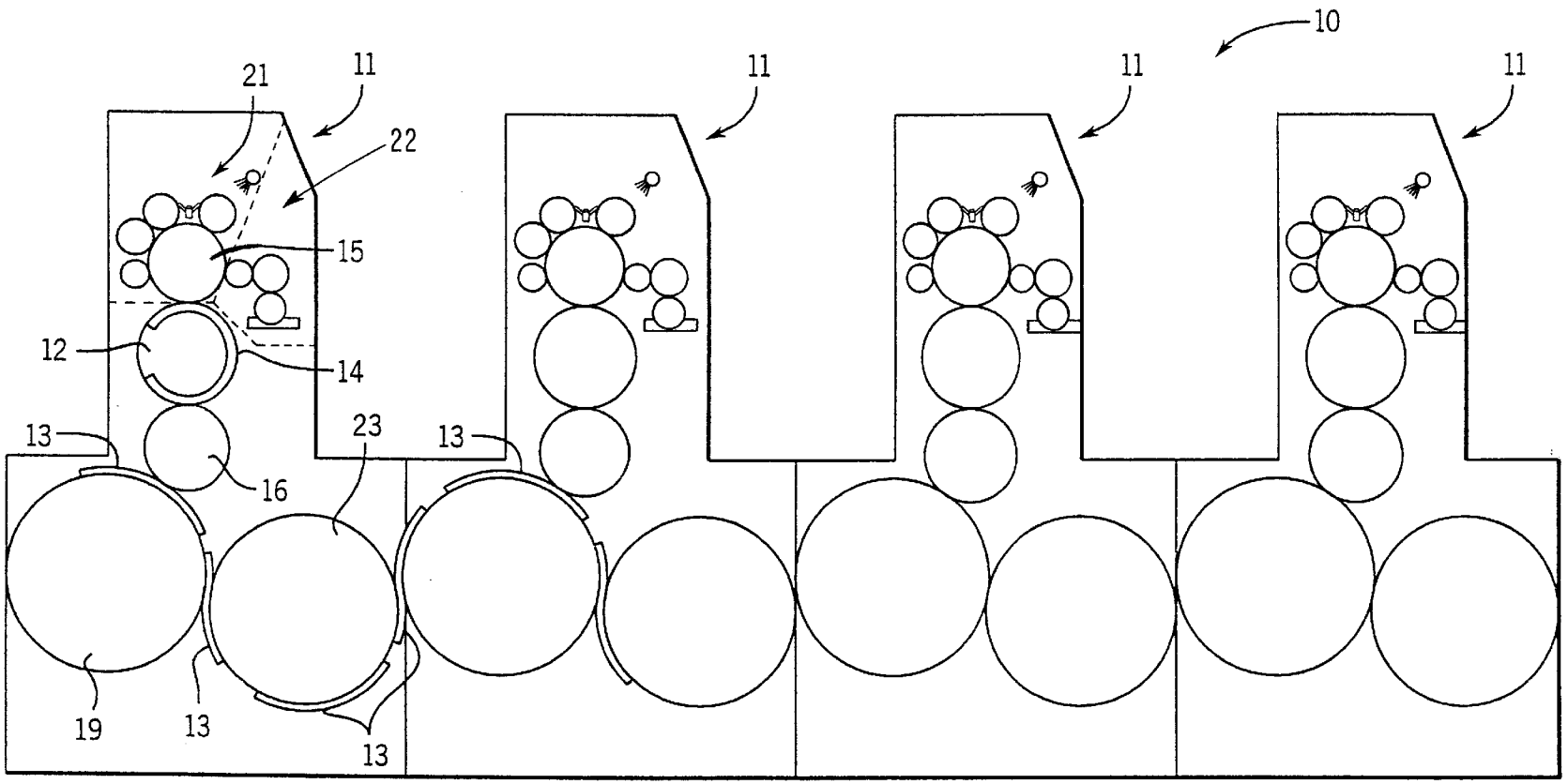
FIG. 1 is a diagrammatic view of a printing press having the keyless inker mounted thereon.

Referring to FIG. 1 of the drawings, the numeral 10 generally designates an offset printing press having a plurality of printing assemblies 11 for sequentially applying different color inks to media 13, such as paper, plastic, and the like, to produce a multi-colored printed product. The ink is conventional ink, and as referred to herein can also include a mixture of conventional ink and dampening fluid.

Each printing assembly 11 includes a plate cylinder 12 carrying a printing plate 14 containing an image for printing on the media. The image is formed by image areas on the plate 14 which receive ink from a single form roller 15 of an inker 21. Ink is applied to the printing plate 14 by the inker 21 to form a transferable inked image thereon corresponding to the image areas on the printing plate 14. The plate cylinder 12 is rotated to engage the printing plate 14 with a rotatably mounted blanket cylinder 16, and transfer the inked image onto the blanket cylinder 16. The blanket cylinder 16 then transfers the inked image to the media which is pinched between the blanket cylinder 16 and an impression cylinder 19. A transfer cylinder 23 adjacent the impression cylinder 19 facilitates the transfer of the media 13 to an adjacent printing assembly 11 for applying a different color image to the media 13. Optionally, a dampener system 22 may be provided to apply dampening fluid to the form roller 15.

Figure 2:
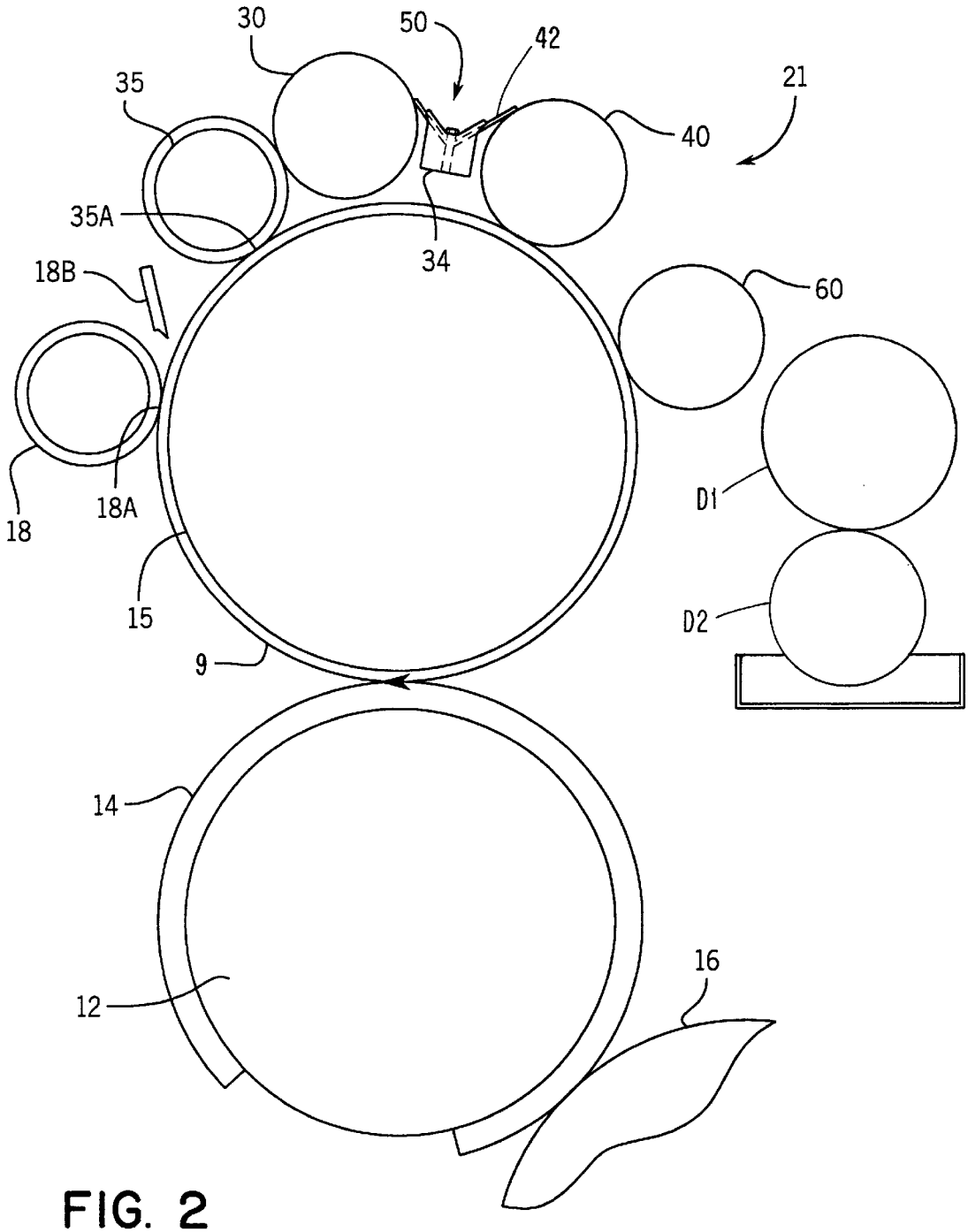
FIG. 2 is a fragmentary cross-sectional view showing the inker of a printing assembly of FIG. 1 in a dry offset printing mode.
Figure 3:
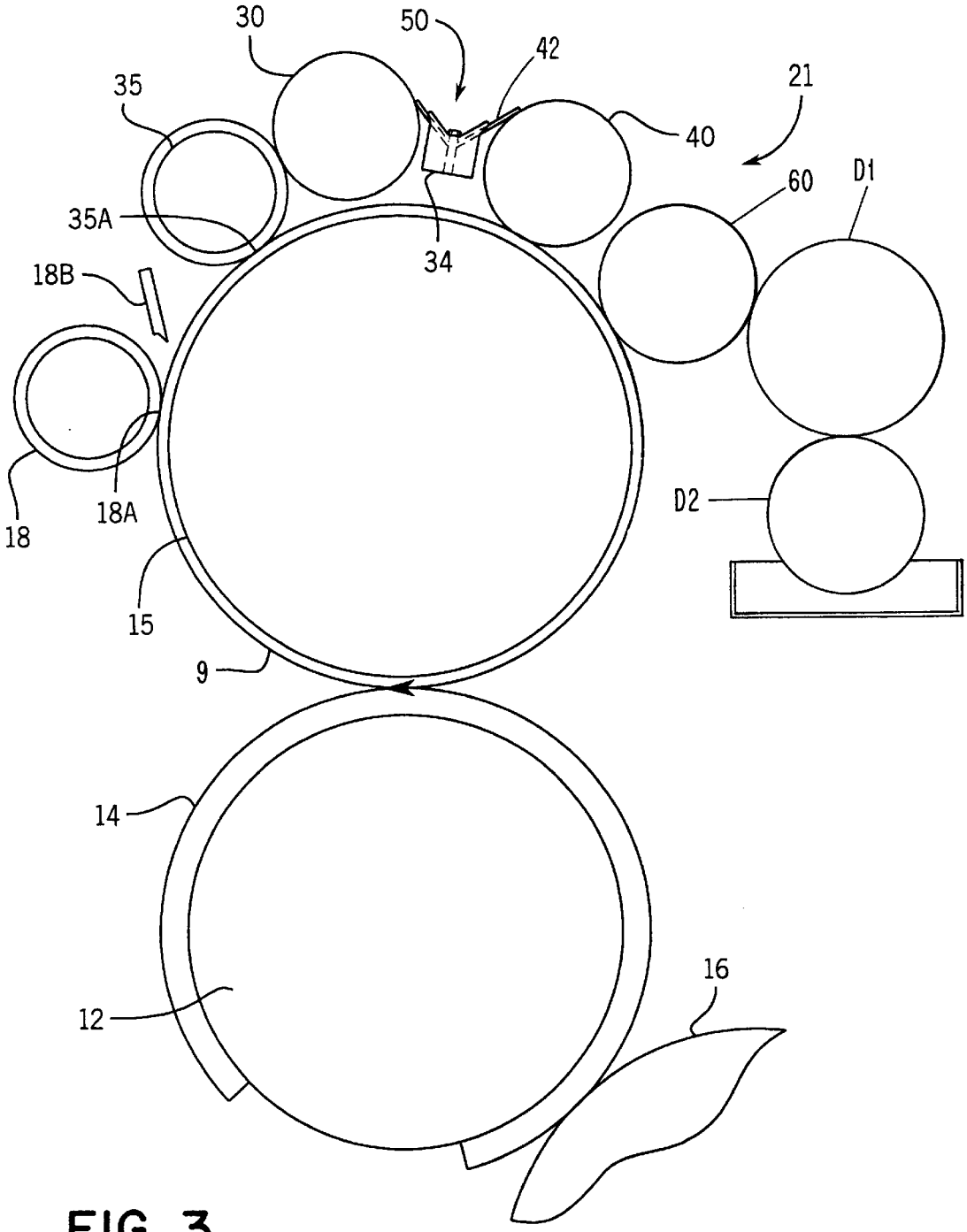
FIG. 3 is a fragmentary cross-sectional view showing the inker of a printing assembly of FIG. 1 in a wet offset printing mode.

Referring to FIGS. 2 and 3, the inker 21 includes a single form roller 15 which applies a film of the ink to the image areas on the printing plate 14. An ink reservoir 50 supplies ink for application to the form roller 15. Additional rotatably mounted rollers described herein apply the ink to the form roller 15, or remove excess ink from the form roller 15 to minimize or eliminate ink accumulation which causes ghosting. Advantageously, the excess ink removed from the form roller 15 is deposited directly back into the ink reservoir 50 for application onto the form roller 15 without recirculating the ink.

The single form roller 15 has a resilient surface, and is mounted in rolling engagement with the printing plate 14. Ink on the form roller 15 corresponding to image areas on the printing plate 14 is applied to the printing plate 14, while ink on the form roller 15 corresponding to non-image areas on the printing plate 14 remains on the form roller 15. Preferably, the circumference of the form roller 15 is not equal to the circumference of the printing plate cylinder 12.

Figures 6, 6A:
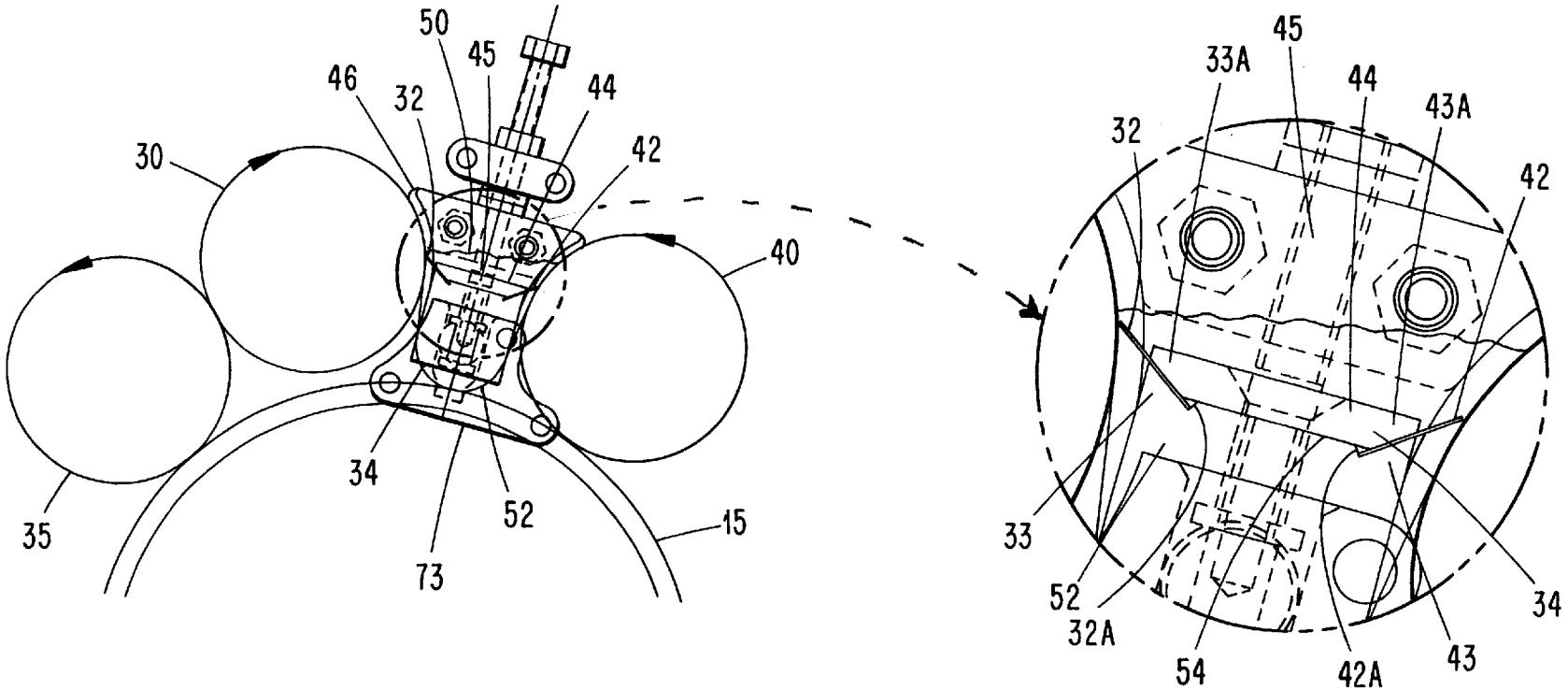
FIG. 6 is a cross sectional view of the ink reservoir of FIG. 1.

A rotatably mounted applicator roller adjacent the form roller 15 receives ink from the ink reservoir 50, and applies it to the form roller 15. Preferably, the applicator roller is an anilox roller 40 having a smooth hard durable surface, such as provided by a ceramic coating, with reservoirs formed therein for carrying ink to the surface of form roller 15. Ink in the ink reservoir 50 flows onto the surface of the anilox roller 40, and is metered by a doctor blade 42 such that a precisely controlled volume of ink is carried by the anilox roller 40 to the form roller 15. Preferably, as shown in FIG. 6, the anilox roller 40 is rotatably driven so that its surface moves in the same direction as the surface of the form roller 15 at the nip between the two rollers. The anilox roller 40 is driven by a variable speed motor to provide slippage between the anilox roller 40 surface and the form roller 15 surface to control the rate at which ink carried in the anilox roller 40 reservoirs is applied to the form roller 15.

Referring back to FIGS. 2 and 3, oscillating rollers 18, 35 are positioned around the form roller 15 for conditioning the ink film on the form roller 15. Oscillator rollers 18 and 35 preferably have a resilient surface, and rotate so that their surfaces move in the same direction as the surface of the form roller 15 at their respective nips so as not to increase the power requirements for rotating the form roller 15 or damage the form roller 15. The surfaces of form roller 15 and oscillator rollers 18 and 35 have a selected hardness (for example, approximately 35 Shore A durometer) such that, when the surfaces of oscillating rollers 18 and 35 are urged into pressure indented relation with the surface 9 of form roller 15, the nip 18*a* and the nip 35*a* will be flat nips which generally result in a film split such that half of the ink film is carried by each roller surface moving out of the nip.

Resilient covered oscillator roller 18 and resilient covered oscillator roller 35 oscillate longitudinally in opposite directions for conditioning the image carried on the surface of form roller 15. It should be readily apparent that, if oscillator roller 35 is moving at a surface speed greater than the surface speed of the form roller 15, it will act as a transfer roller, and carry more ink out of the flat nip 35*a* than is carried out of the nip on the surface of form roller 15. Preferably, the surface speed of roller 35 is adjustable for controlling the rate at which ink is removed from the surface of form roller 15. As best shown in the detail of FIG. 5, a gear 37 mounted at one end of the oscillator roller 35 is rotatably driven by gear 34 on the adjacent subtractive roller 30.

Oscillator roller 35 removes excess ink from the surface of the form roller 15 to prevent ink accumulation, and transfers it to the smooth surface of a subtractive roller 30. Preferably, as shown in FIG. 6, the surface of the subtractive roller 30 rotates in the same direction as the surface oscillator roller 35 at the nip therebetween. This minimizes the power required to rotate the rollers 30 and 35. The subtractive roller 30 has a smooth surface which is harder than the oscillator roller 35 surface, such as provided by a ceramic coating, to facilitate the ink transfer. Ink on the subtractive roller 30 is scraped directly into the ink reservoir 50 by a scraper blade 32 which forms a part of the ink reservoir.

Figure 5:
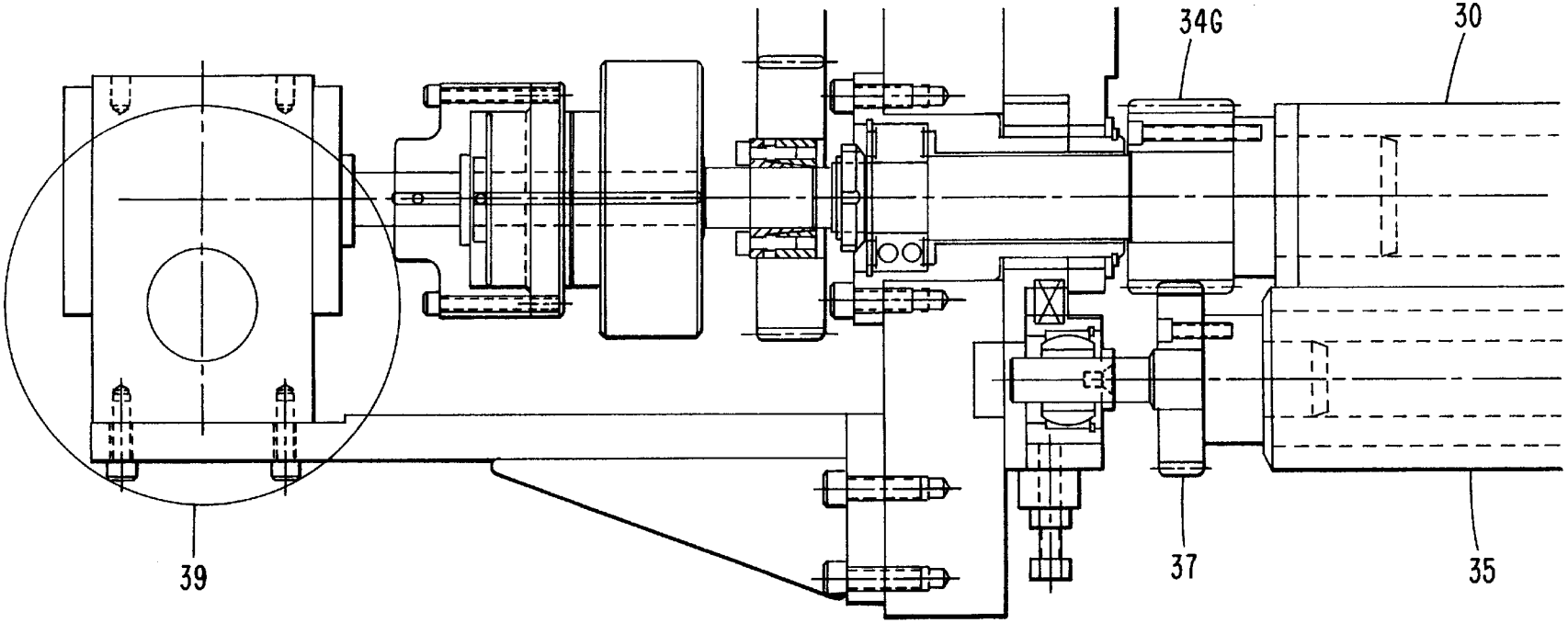
FIG. 5 is a fragmentary view of the subtractive roller in engagement with the oscillator roller of FIG. 2.

Preferably, subtractive roller 30 is rotatably driven by a variable speed motor 39, shown in FIG. 5. The gear 34G on subtractive roll 30 engages gear 37 to drive the oscillating roller 35. Roller 30 is preferably driven by the variable speed motor 39 such that the rate at which ink is removed from the form roller 15 can be controlled. Although, a single motor driving roller 35 and roller 30 is preferred, each roller 30 and 35 can be individually motor driven without departing from the scope of the present invention.

The oscillating roller 35, subtractive roller 30, and anilox roller 40 are preferably rotatably driven at surface speeds different from the surface speed of the form roller 15. The oscillating roller 35 is preferably driven in a range between about 1% and 10% faster than the surface speed of form roller 15 and more preferably between 2% and 5% faster than the surface speed of form roller 15 for removing more than one-half of the ink film from the surface of form roller 15. Thus, the oscillating transfer roller 35 is capable of efficiently removing ink from the surface of form roller 15 after it contacts the printing plate to prevent accumulation of excess ink on the form roller 15 surface.

As shown in FIG. 6, the ink reservoir 50 supplies ink to the anilox roller 40 for application to the form roller 15, and receives excess ink from the subtractive roller 30. The ink reservoir 50 is supported on hangers (one of which is identified by the numeral 73 in FIG. 6) and is positioned between the subtractive roller 30 and the anilox roller 40, such that ink removed from the subtractive roller 30 is deposited directly into the ink reservoir 50, and ink in the reservoir is applied directly to the anilox roller 40 preferably by downward flow due to gravity. Additional ink is also supplied to the ink reservoir to ensure the ink level in the reservoir 50 is sufficient for continuously feeding the anilox roller 40. Advantageously, by positioning the ink reservoir between the subtractive roller and the anilox roller, recirculation of the ink is not required. Furthermore, by individually metering the ink onto the form roller 15, and removing the ink from the form roller 15, the film on the form roller 15 can be controlled more precisely than the prior art without increasing the power requirements for rotating the form roller 15.

The ink reservoir 50 includes an adjustable blade holder 34 having a doctor blade 42 and a scraper blade 32 mounted thereto. The blades 32, 42 form a trough extending past the length of the anilox roller 40 and the subtractive roller 30. The trough holds a mass of the ink, commonly referred to as an "ink fountain".

The blade holder 34 is adjustable relative to each of the rollers 30 and 40 to position the trough therebetween. Blade holder 34 is adjustable vertically in a slide block (not shown) for positioning scraper blade 32 and doctor blade 42 in engagement with the subtractive roller 30 and the anilox roller 40, respectively. Blade holder 34 preferably is rotatable about its longitudinal axis relative to the slide block for adjusting pressure of scraper blade 32 relative to the pressure of doctor blade 42.

As shown in the detail of FIG. 6(*a*) the blade holder 34 comprises a base 52 having a pair of projections 33 and 43 extending outwardly from opposite sides thereof with a relieved area 54 forming shoulders 32*a* and 42*a* adjacent opposite ends thereof for positioning scraper blade 32 and doctor blade 42. A blade clamp 44 is configured to be received in the base relieved area 54, and has projections 33*a* and 43*a* adjacent opposite sides thereof. A bolt 45 extends through blade clamp 44, and is received in a threaded aperture in base 52 for grippingly engaging scraper blade 32 and doctor blade 42 between the blade clamp 44 and base 52.

When clamped on the blade holder 34, the scraper blade 32 extends away from one side of the blade holder 34, and engages the subtractive roller 30 to scrape excess ink therefrom. The doctor blade 42 extends away from the opposite side of the blade holder 34 toward the anilox roller 40 to meter the application of ink thereon. Preferably, the scraper blade 32 and doctor blade 42 scrape and meter the respective rollers 30 and 40 above a line extending through longitudinal axes of the rollers 30, 40, and may be formed of, for example, fiber glass material.

End dams 46 are positioned adjacent opposite ends of blade holder 34, scraper blade 32, and doctor blade 42 for capping each end of the trough. A cavity is formed in an inwardly directed face of each end dam 46 to receive the blade holder 34 and blades 32, 42, and sealingly cap the ends of the trough. The volume of ink extends above upper ends of scraper blade 32 and doctor blade 42 to assure that ink is always present to provide lubrication between the scraper blade 32 and the surface of subtractive roller 30, and to provide sufficient ink between the doctor blade 42 and the surface of the anilox roller 40 for application to the surface of the form roller 15.

Figure 4:
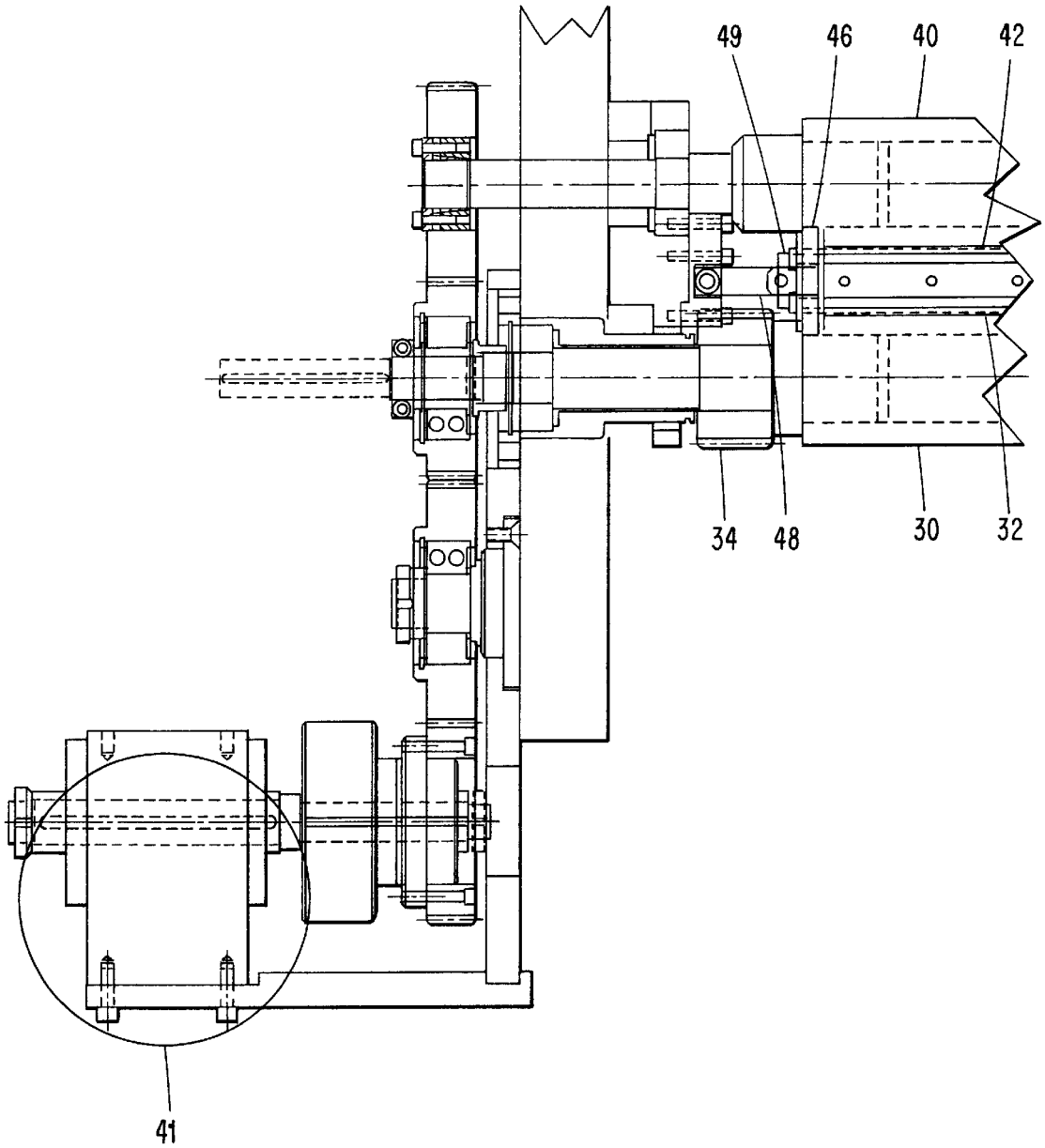
FIG. 4 is a fragmentary top view of the inker of FIG. 1.
Figure 7:
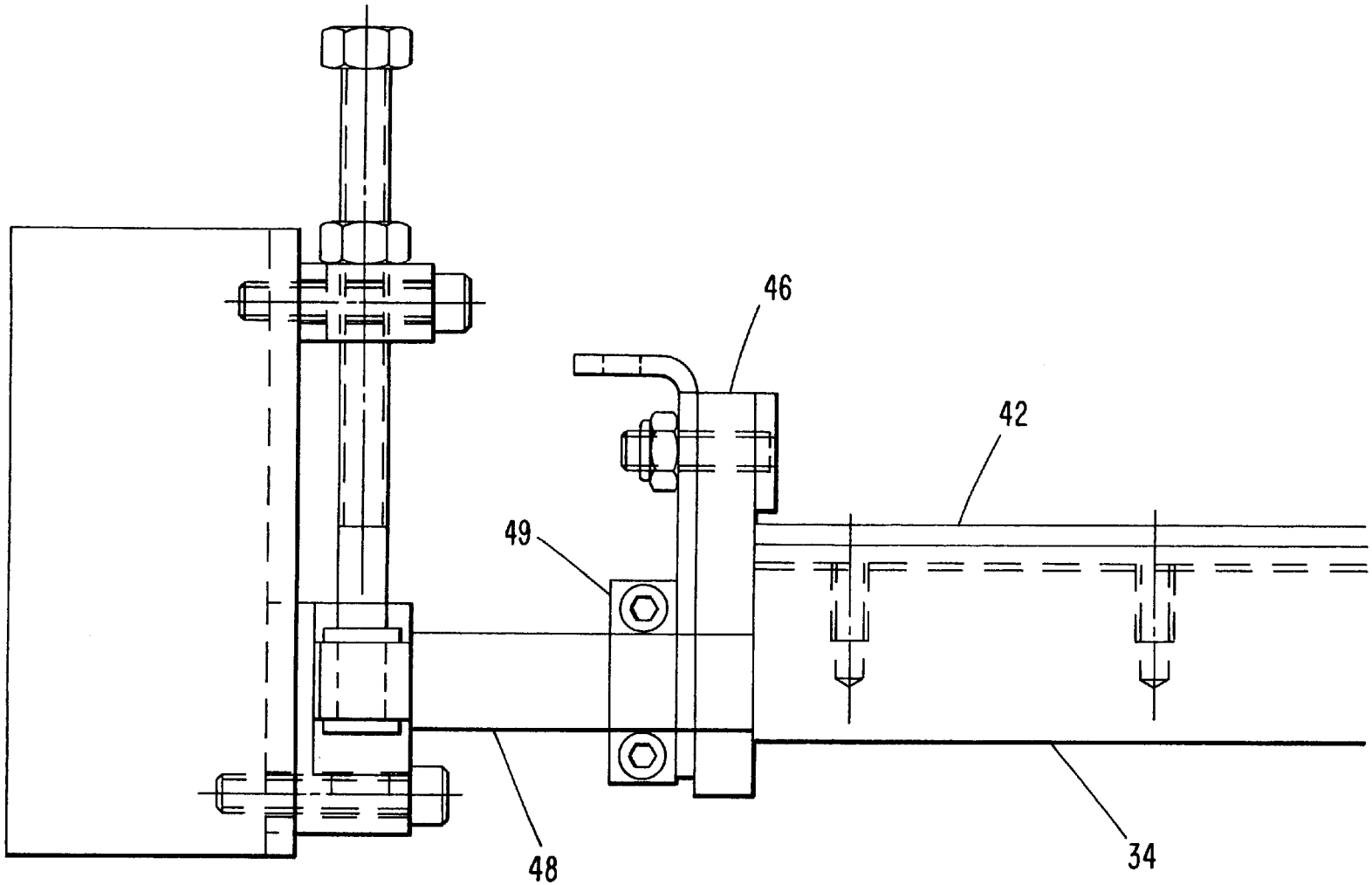
FIG. 7 is a detailed view of the end dam assembly of the ink reservoir of FIG. 6.

As best illustrated in FIGS. 4 and 7, the end dams 46 engage the subtractive roller 30 and the anilox roller 40. Surfaces of the end dams sealingly engage the end circumferential surfaces of rollers 30 and 40. These surfaces are provided with a coating which forms smooth self-lubricating surfaces to allow rotation of the rollers 30, 40 while retaining ink in the reservoir. Bearers 48 and brackets 49 hold the end dams in position with respect to the rollers 30 and 40.

As shown in FIG. 2, when printing in a dry offset mode, temperature controlled rollers 18 and 60 which are internally temperature controlled and have outer surfaces which are good thermal conductors can be provided. The temperature controlled rollers 18 and 60 maintain the ink at a desired temperature for printing in the dry offset mode. If the inking system hereinbefore described is used in a printing press printing in a dry offset printing mode, temperature controlled rollers 18 and 60 will be urged into pressure indented relation with the surface of form roller 15, and temperature controlled water will be circulated through rollers 18 and 60. The temperature controlled rollers 18 and 60 maintain ink moving out of the nip between the surface of form roller 15 and temperature controlled rollers within a predetermined temperature range of, for example, about 67° to 72° F.

As shown in FIG. 3, if the inking system is used in a printing press printing in a wet offset printing mode, such as in lithographic printing, the temperature controlled rollers 18 and 60 can be used to stabilize the ink temperature if necessary. A dampening system, for example of the type commercially available from Epic Products International Corporation, Arlington, Tex. can be provided for applying a precisely metered film of dampening fluid to the surface of ink carried on form roller 15. Such a dampener generally comprises a pan for dampening fluid and a resilient covered metering roller D2 moving through dampening fluid in the pan. The roller D2 forms a flooded nip between a hydrophilic chrome roller D1 and the resilient covered pan roller D2. A thin film of dampening fluid carried by the hydrophilic chrome roller D1 is applied to the film of ink on form roller 15. An air knife 18B is mounted to evaporate dampening fluid from the surface of oscillator roller 18 which is positioned to remove dampening fluid from the surface 9 of form roller 15.

Preferably, the blade clamp 44, scraper blade 32, and doctor blade 42 are assembled as a single removable unit from blade holder base 52, such as by attaching the blades 32, 42 to the blade clamp 44 using methods known in the art, such as bolting, welding, and the like, to simplify the color change procedure in the printing assembly 11. The removable unit is removed from the inker 21 during color change for inker wash-up purposes, and replaced with a wash-up assembly 70, shown in FIG. 8. The wash-up assembly 70 is installed in the removable unit location to collect wash-up solution and ink cleaned out of the printing assembly 11.

Figure 8:
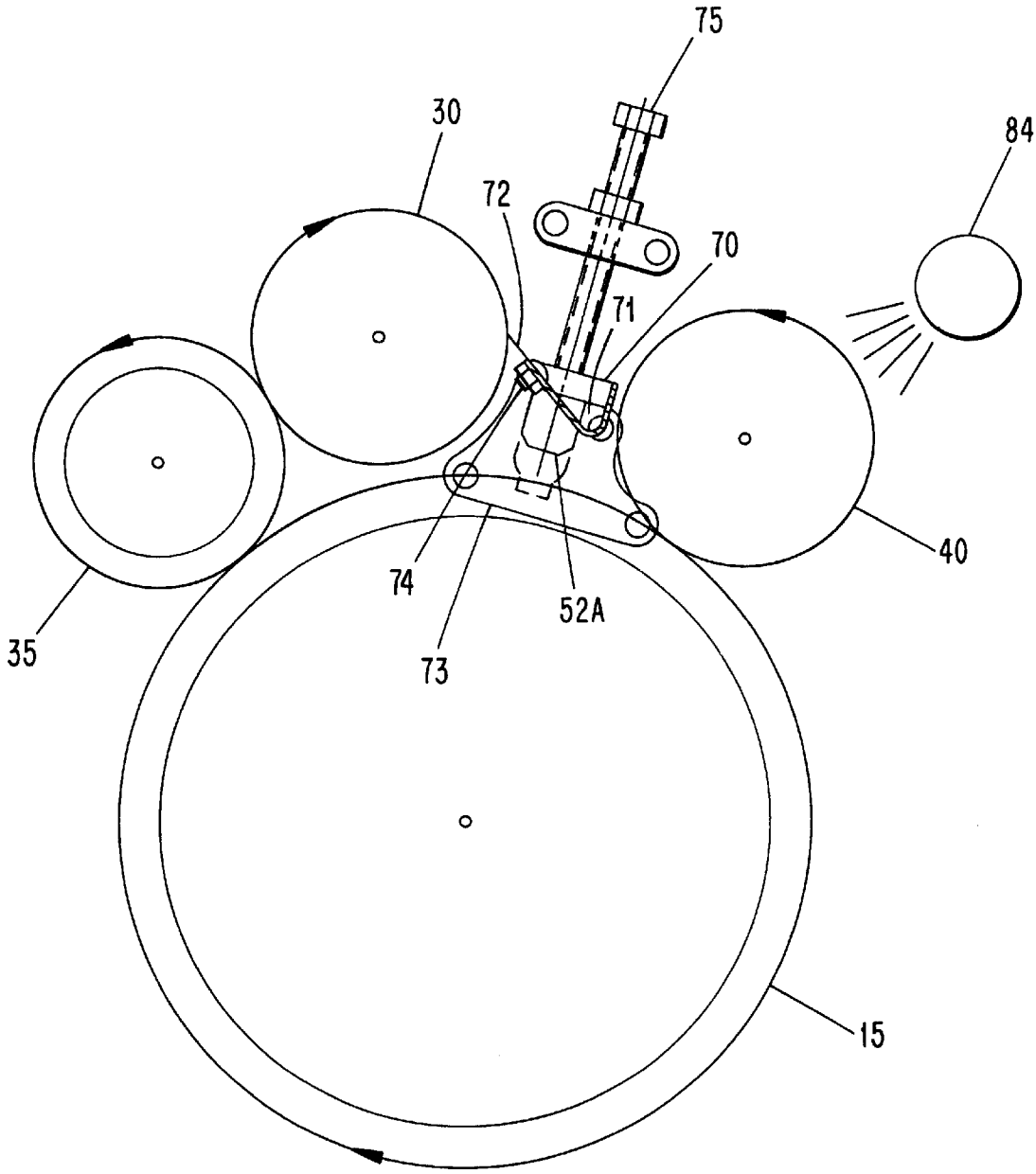
FIG. 8 is a cross sectional view of a wash-up blade and tray assembly.

As shown in FIG. 8, the wash-up assembly 70 includes a wash-up blade 72 contacting the subtractive roller 30 for scraping ink and wash-up solution off of the subtractive roller 30. In use the wash-up assembly is secured to the inker by means of hangers 73 located on opposite sides of the inker. The wash-up blade 72 is clamped to the blade holder base 52A by the blade clamping screw and nut 74. The wash-up blade together with end barriers (not shown) form a trough 71 for collecting the ink and wash-up solution from the inker 21 during a color change. Preferably, the wash-up blade 72 and blade clamp 74 are assembled as a single removable unit to simplify installation and removal of the assembly 70 from the inker 21, such as by attaching the wash-up blade assembly to hangers 73. Handles attached to ends of the wash-up assembly allow a user to grasp the assembly 70 when installing or removing the assembly 70 from the inker 21. Tension on the wash-up blade may be adjusted using the blade tension adjustment screw 75. During wash-up a spray bar 84 adjacent the applicator roller 40 may be used to spray wash-up solution onto the surface of the applicator roller 40 which applies the solution to the form roller 15. The wash-up solution flushes ink from the rollers in the inker, and is collected in the trough of the wash-up assembly 70. When the wash-up process is complete, the wash-up assembly 70 is removed, and a clean blade clamp, scraper blade, and doctor blade are installed. The collected ink and wash-up solution in the trough of the wash-up assembly 70 may be discarded.

Figure 9:
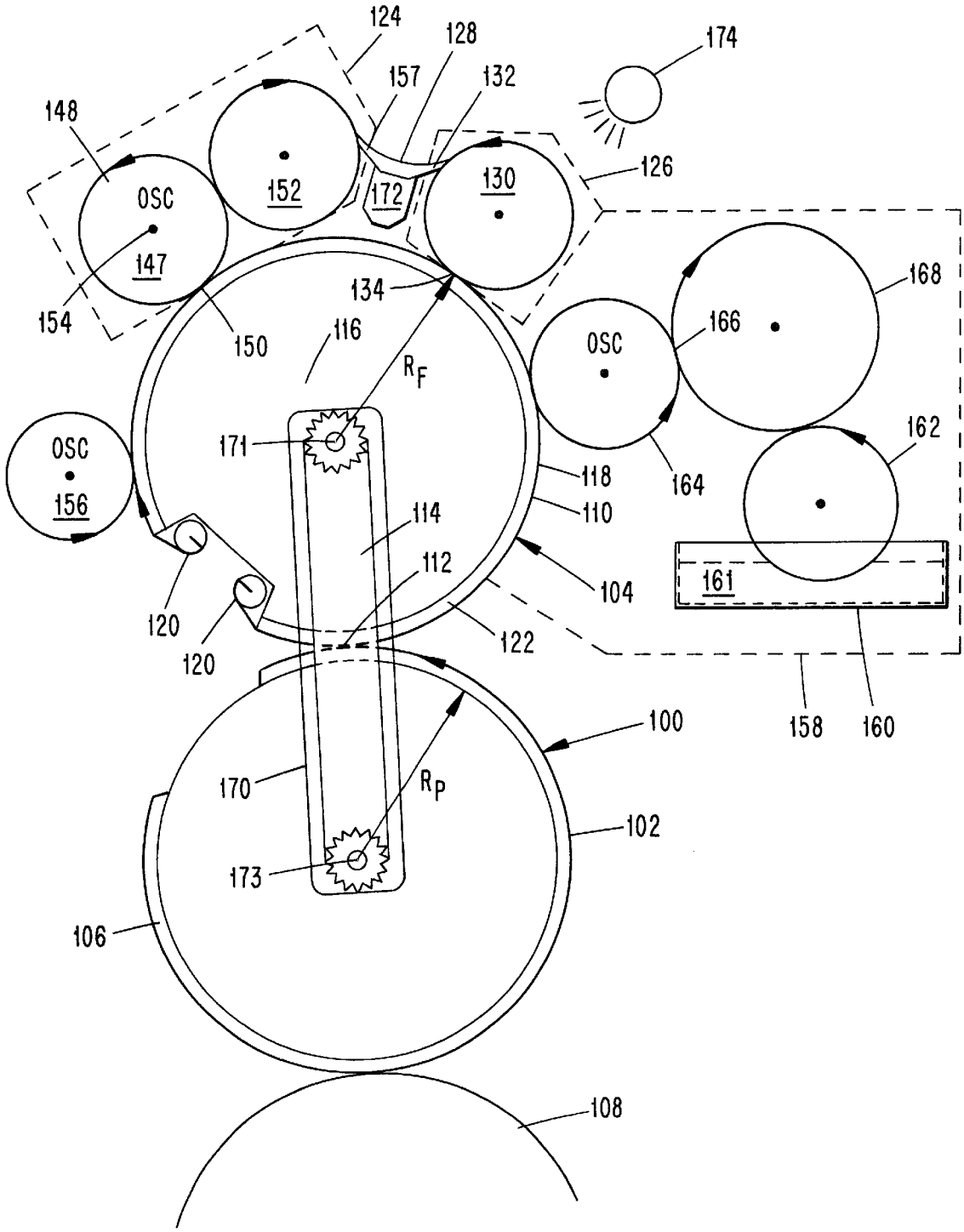
FIG. 9 is a diagrammatic view of a printing assembly with a keyless subtractive inker illustrating various aspects of the present invention.

Another preferred embodiment of the present invention is illustrated in FIG. 9. A printing assembly 100 includes a plate cylinder 102 and an inking system 104. In a printing process, one or more printing assemblies may be used to produce single or multi-color printed product. In the process an ink and/or a coating is applied by each of the printing assemblies.

In offset printing, the plate cylinder 102 is rotated to engage one or more removable printing plates 106 with a rotatably mounted blanket cylinder 108. The blanket cylinder 108 then transfers inked image(s) to the media which is pinched between the blanket cylinder 108 (a portion of which is shown in FIG. 9) and an impression cylinder (not shown in FIG. 9). Sequential adjacent printing assemblies may be used for applying coatings or different color images to the media as previously described in connection with FIG. 1.

The inking system 104 may include a keyless, subtractive inking system using a single form roller 110 such as previously described. The plate cylinder and the form roller have different diameters and have different surface speeds at a nip 112 formed between the plate cylinder and the form roller. The differential speed produces sharper printed images and tends to remove debris from the plate surface. It also tends to eliminate repeats and inker related streaks produced by conventional inkers. Advantageously, the difference in surface speeds at the nip 112 is greater than one foot per minute, for example, between four and ten feet per minute.

In preferred embodiments, the plate cylinder 102 and the form roller may be rotated at the same rpm, so that the same areas on the form roller contact the same areas on printing plate(s) 106 during each revolution of the plate cylinder. This may be accomplished by appropriate selection of conventional drives, for example, the chain coupled drive 114 and drive motor 116 shown in FIG. 9.

The rotation of the single form roller and plate cylinder at the same rotational speed eliminates repeats or ghostings caused by a lack of registration between surfaces of the printing plate and the form roller. This effect may be explained with reference to FIG. 10.

Figure 10A:
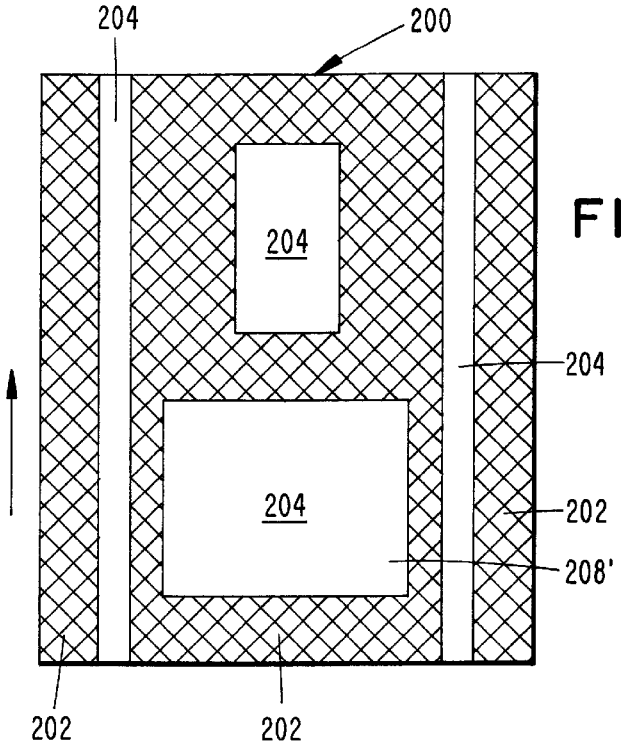
FIGS. 10(*a*), (*b*) & (*c*) are illustrations of various printed images.
Figure 10B:
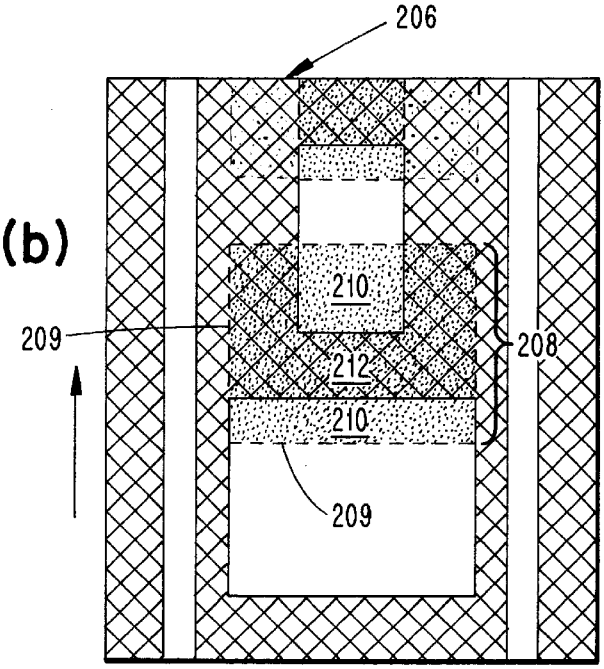
Figure 10C:
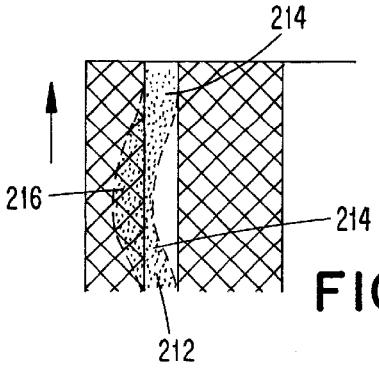

FIG. 10(*a*) illustrates a layout 200 which is difficult or impossible to print without ghosting, or repeats with conventional printing systems. The arrows in the figure represent the direction the sheet is transported through the press. Difficulties arise from the fact that printing of the inked areas 202 (cross-hatched areas) tends to deplete ink on the corresponding areas of the form roller, while the unprinted areas 204 correspond to areas where build up of unused ink occurs on the form roller.

FIG. 10(*b*) illustrates the result of these effects on a subsequently printed sheet 206. For example, the area 208 is affected by the buildup of ink on the form roller caused by the printing of the corresponding area 208' in the previously printed page. The result of this build-up is ghosting in areas 210 (dotted areas) and greater ink density in repeat area 212 (dotted and cross-hatched area). The result is an inferior printed product which does not faithfully replicate the desired image depicted in FIG. 10(*a*) and which contains phantom lines (for example, lines 209) at the edges of the ghosting and repeat areas.

By employing the above described techniques, registration between the surfaces of the printing plate and the form roller is achieved, thus minimizing this kind of ghosting and repeating. It will be understood, however, that such a system may cause a more rapid build up of ink in the areas on the form roller corresponding to areas 204. This problem may be addressed by use of a subtractive inking system such as described herein.

The difference in surface speeds is achieved by employing somewhat different radii for the form roller 110 and plate cylinder 102. These radii are represented in FIG. 9 as $R_F$ and $R_P$, respectively. Examples of these radii are $R_F$=7.820 inches and, $R_P$=8.000 inches. Employing a form roller of comparable size to the plate cylinder results in a form roller larger than would normally be found in conventional inking systems, particularly those using multiple form rollers. Accordingly, maintaining the form roller may create difficulties due to its size and the difficulty of removing such a large cylinder from the system for repair. In accordance with a preferred embodiment of the present invention, the form roller 110 has a removable covering 118 held in position by quick release mechanisms 120. A permanent, resilient underlayer 122 may also be employed.

The keyless subtractive inking system 104 of FIG. 9 will now be described. The inking system includes the form roller 110, an ink subtractive subsystem 124, an ink application subsystem 126 and a common ink reservoir 128.

The ink application system 126 may include an applicator roller 130 and a doctor blade 132. Ink on the applicator roller 130 is deposited on the form roller at nip 134. The structure and operation of the ink application system is described in greater detail in FIG. 11.

Figures 11, 11A:
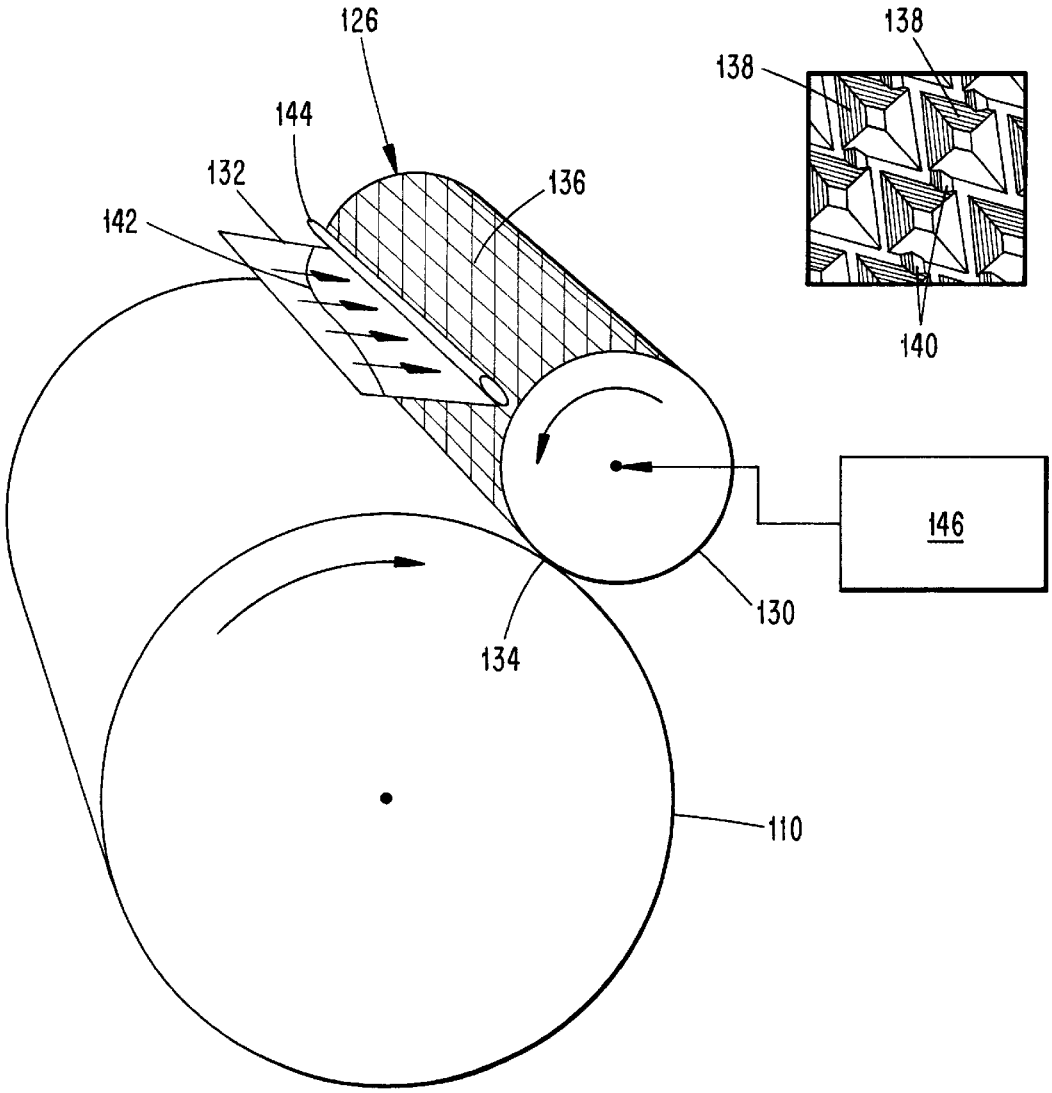
FIG. 11 is a pictorial view of an ink application subsystem of the apparatus described in connection with FIG. 9.

FIG. 11 is a pictorial view of the ink application system 126 of a preferred embodiment of the present invention. The applicator roller 130 for applying ink to the form roller 110 has a cylindrical surface 136 with a surface structure particularly suited for use in the claimed invention. Carbon fiber anilox rolls of a type conventionally used in flexo printing applications may be used. A portion of that surface structure of an example of such a roll is shown magnified in detail in FIG. 11(*a*). The surface is characterized by a regular array of cells or wells 138. The wells may be pyramidal in shape as shown. Preferably, adjacent wells are interconnected by offset channels 140, through which ink may pass. Rollers surfaced in this fashion are available from PAMARCO Company. The particular surface shown in FIG. 11(*a*) is sold under the mark Roto-Flo™ Quad. The surface is produced in various cell counts and cell depths. An example of a surface usable in the present invention has a cell count of 200 and cell depth of 35.64 $\mu$m.

In use, ink 142 maintained in the ink reservoir flows downward to ink fountain 144. The wiper blade 132 meters ink from the reservoir onto the applicator roller. Ink at the fountain is picked up in the cells 138 of the applicator roller 130 and deposited onto the form roller 110.

The applicator roller 130 is driven to rotate by a variable speed driver 146. The driver may be a variable speed motor, variable gear or belt drive or the equivalent. Applicants have determined that the roller speed difference at nip 134 effects the amount of ink applied to the form roller 110. Varying the rotational speed of the applicator roller may be used to vary the amount of ink applied to the form roller, and ultimately the amount of ink applied to the printed media.

With reference again to FIG. 9, the ink subtractive system 124 may include a transfer roller 147 with a resilient surface or cover 148. The surface of the transfer roller contacts the surface of the form roller 110 at nip 150; both surfaces move in the same direction at the nip 150 as shown by the circumferential arrows associated with the rolls. A subtractive roller 152 adjacent the transfer roller 147 receives excess ink from the transfer roller. The transfer roller 147 may be driven to oscillate in the direction of the axis 154 of rotation of the transfer roller 147 which is perpendicular to the plane of the figure. Such oscillation helps to prepare or "rough-up" the ink prior to subtraction. Vibrating roller 156 serves a similar purpose. Ink is removed from the subtractive roller 152 by blade 157.

An aspect of the present invention is illustrated in FIG. 10(*c*). FIG. 10(*c*) is an example of a printed image produced when the ink subtraction subsystem 124 is disengaged. FIG. 10(*c*) shows the upper left hand corner of the image of FIG. 10(*a*) as it might be printed if the ink subtractive subsystem had been disengaged. Ink buildup would occur on the form roller in the area corresponding to the unprinted stripe 210. The oscillation roller 156 would tend to move portions of the ink buildup stripe. Without the subtraction subsystem 124, this buildup would not be removed, resulting in oscillating phantom stripe 212, which forms ghosting regions 214 (dotted area) and repeat regions 216 (dotted and cross-hatched region) in a subsequently printed page.

Referring once more to FIG. 9, the system may optionally include a dampening system 158. When printing in a wet offset printing mode, a dampening system, such as, for example, the type commercially available from Epic Products International Corporation of Arlington, Tex. can be provided for applying a precisely metered film of dampening fluid to the surface of ink carried on the form roller 110. Such a dampener may comprise a pan 160 for containing the dampening fluid 161, and a resilient covered pan roller 162 pressure indented with a hydrophilic chrome roller 168, then rotated by a variable speed motor (not shown) to apply the necessary dampening fluid to the surface of the oscillating resilient covered roller 164 to be distributed to the surface of the form roller 110.

The apparatus of FIG. 9 is particularly well adapted for practicing efficient wash-up procedures, as now will be described. Assume first that the inking system 104 has been used to apply ink to the plate cylinder 102 as previously described. In a wash-up procedure, the plate cylinder may be disengaged from the form roller 110. This permits rotation of the inking system rollers independent from the rotation of the press drive. While wash-up is performed, the plate cylinder may be accessed to clean and/or replace the plate for subsequent printing operations. A mechanism for disengaging the form roller and the plate cylinder is indicated schematically at 170. It may be constructed using conventional clutch and gearing mechanisms.

Figure 12:
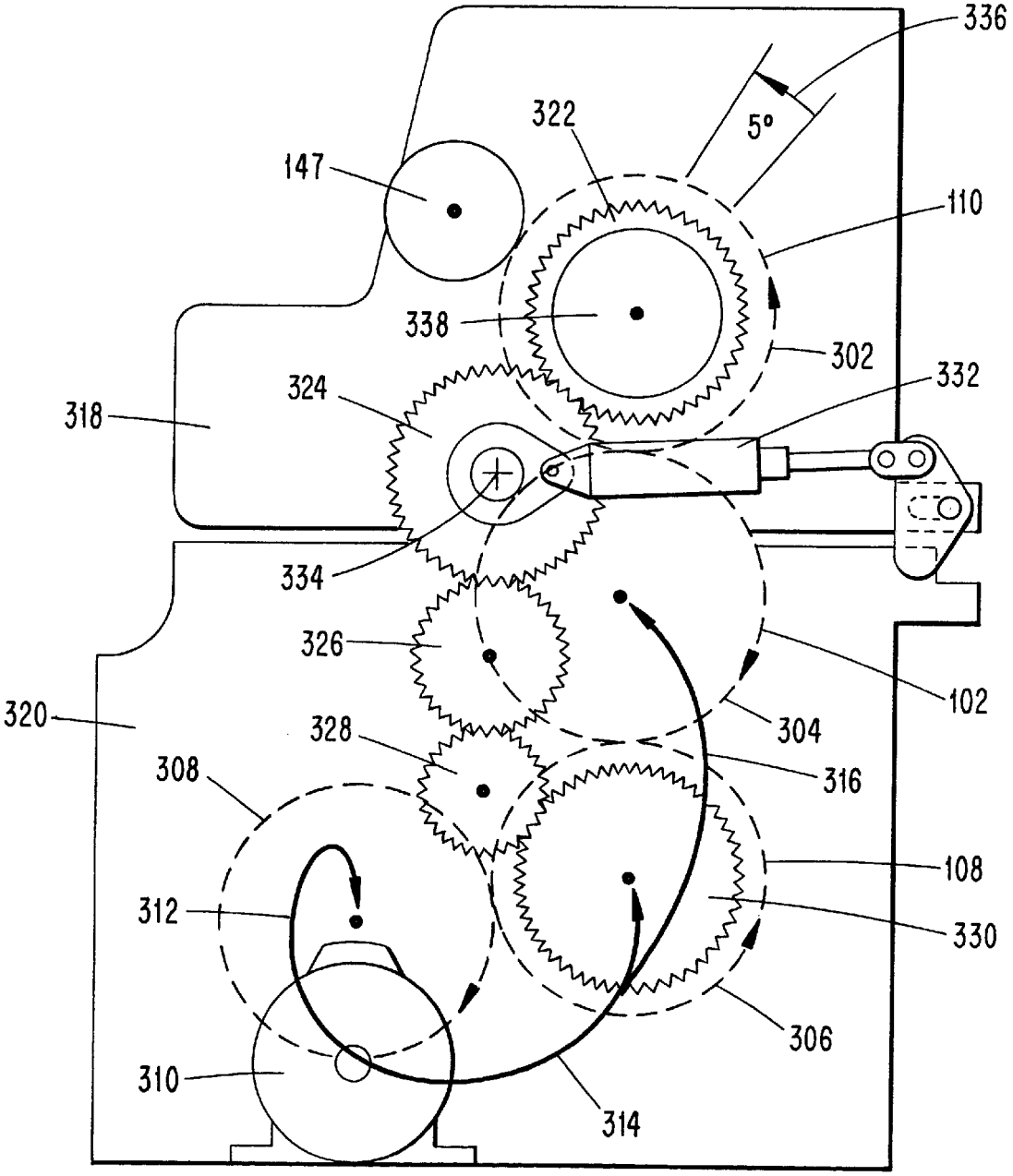
FIG. 12 illustrates a mechanism for driving and disengaging a form roller of an inker embodiment of the present invention.

FIG. 12 illustrates an embodiment of a mechanism for driving the form roller 110 and for disengaging it from the press drive during wash-up. In FIG. 12 the rotating surface of the form roller 110 is indicated by arrow 302; that of the plate cylinder 102 by arrow 304; that of the blanket cylinder 108 by arrow 306 and that of the impression cylinder by arrow 308. The main press drive for the latter three cylinders is indicated schematically by motor 310 and power delivery paths 312, 314 and 316 which are intended to represent generally conventional power train elements used in press construction.

The form roller 110 of the inker is rotatably mounted on inker chassis 318. The inker chassis is pivotably mounted on the printer chassis 320. During printing the form roller 110 of the inker is rotated by a series of gears 322, 324, 326, 328 and 330 which rotate in synchrony with the plate cylinder 102 and the press drive.

During wash-up, hydraulic cylinder 332 is actuated to rotate the inker chassis 318 about axis 334 through, for example, about a 5° angle as indicated by the arrow 336.

This movement disengages the surface of the form roller from the printing plate. Air clutch 338 may be used to disengage gear 322 from the form roller 110 and, thereby, disengage the form roller from the press drive so that the press cylinders and form roller may be rotated separately from one another. In this configuration the form roller may, for example, be rotated during wash-up by functional engagement with the rotating transfer roller 147 of the subtractive system described in connection with FIG. 9.

Referring once more to FIG. 9, during wash-up, excess ink may be removed from the ink reservoir 128. Alternatively, a removable ink unit 172 may be removed and replaced with the wash-up assembly described above. A conventional ink solvent or wash-up fluid may then be applied to the inking system. In one embodiment, the fluid may be applied to the applicator roller 130 using the spray bar 174. Alternatively or in addition, wash-up fluid may be sprayed on other of the rollers in the inking system. As the rollers of the inking system are rotated, a mixture of the wash-up fluid and residual ink on the rollers is gradually deposited in the reservoir. This mixture can be emptied or wiped up to complete the wash-up and prepare the system for charging with a new ink supply.

The wash-up process proceeds essentially automatically and harnesses the ink subtraction system to remove and collect the mixture. The wash-up procedure may be performed using a smaller amount of wash-up fluid relative to conventional wash-up processes, with consequential material savings and environmental benefits. Because the inking system is disengaged from the press drive and plate cylinder during wash-up, maintenance can be simultaneously performed on the press, plates may be cleaned and replaced, etc.

While there has been shown and described what are at present considered the preferred embodiment of the invention, it will be obvious to those skilled in the art that various changes and modifications can be made therein without departing from the scope of the invention.

We claim:

1. A printing system having a rotating plate cylinder including at least one printing plate and a form roller for applying ink to the at least one printing plate wherein:

the plate cylinder and the form roller are rotated at the same rpm so that the same areas on the form roller contact the same areas on the at least one printing plate during each revolution of the plate cylinder; and the plate cylinder and the form roller have different diameters and have different surface speeds at a nip formed between the plate cylinder and the form roller.

2. The printing system of claim 1 wherein the difference in surface speeds at the nip formed between the plate cylinder and the form roller is greater than one foot per minute.

3. The printing system of claim 2 wherein the difference in surface speeds at the nip formed between the plate cylinder and the form roller is between four and ten feet per minute.

4. The printing system of claim 1 wherein repeats and ghostings caused by a lack of registration between surfaces of the printing plate and the form roller are substantially eliminated.

5. The printing system of claim 1 wherein the form roller has a removable covering.

6. The printing system of claim 5 wherein the form roller has a resilient underlayer and the removable covering is smooth.

7. The printing system of claim 1 wherein the form roller is part of a keyless subtractive inking system which further comprises:

a transfer roller adjacent the form roller for removing excess ink from the form roller;

a hard surfaced subtractive roller adjacent the transfer roller for receiving excess ink from the transfer roller;

a scraper blade adjacent the subtractive roller for scraping excess ink from the subtractive roller;

an ink reservoir adjacent the scraper blade for receiving ink scraped from the subtractive roller and for supplying ink for application onto the form roller; and an applicator roller interposed between the ink reservoir and the form roller, wherein ink from the ink reservoir is applied to the form roller by the applicator roller.

8. The printing system according to claim 1 wherein the form roller consists of a single form roller.

9. The printing system of claim 1 wherein the form roller is part of a keyless subtractive inking system which further comprises:

a transfer roller adjacent the form roller for removing excess ink from the form roller;

a hard surfaced subtractive roller adjacent the transfer roller for receiving excess ink from the transfer roller;

a scraper blade adjacent the subtractive roller for scraping excess ink from the subtractive roller; and an ink reservoir adjacent the scraper blade for receiving ink scraped from the subtractive roller and for supplying ink for application onto the form roller.

10. The printing system of claim 1 further comprising a subtractive roller system for removing excess ink from the form roller.

11. A printing system comprising:

a plate cylinder;

an inking system comprising:

a form roller engaging a plate cylinder for applying ink to the plate cylinder;

an applicator roller for applying ink to the form roller from a common ink reservoir; and an ink subtractive means for removing ink from the form roller and depositing the removed ink in the common reservoir; and means for disengaging the form roller from the plate cylinder and for separately driving the inking system during wash-up.

12. The printing system of claim 11 further comprising means for applying wash-up fluid to at least one roller in the inking system.

13. The printing system of claim 11 wherein the ink subtractive means comprises:

a transfer roller adjacent the form roller for removing excess ink from the form roller during printing and removing a mixture of wash-up fluid and residual ink from the form roller during wash-up;

a hard surface subtractive roller adjacent the transfer roller for receiving excess ink from the transfer roller during printing and for receiving the mixture from the transfer roller during wash-up; and a scraper blade adjacent the subtractive roller for scraping excess ink from the subtractive roller during printing and depositing the excess ink in the reservoir and for scraping excess mixture from the subtractive roller during wash-up and depositing the mixture in the reservoir.

14. The printing system of claim 12 wherein the wash-up fluid is applied to rollers of the ink subtractive means.

15. The printing system of claim 12 wherein the ink subtractive means removes a mixture of wash-up fluid and residual ink from the form roller and deposits the mixture into the common reservoir during wash-up.

16. The printing system according to claim 11 wherein the form roller consists of a single form roller.

17. In a printing system having a rotatable plate cylinder including at least one printing plate and a rotatable form roller for applying ink to the at least one printing plate, a method for minimizing repeating from prior rotations comprising:

selecting a plate cylinder and form roller having different diameters;

selecting a speed of rotation for the plate cylinder and form roller; and rotating the plate cylinder and form roller at the same rpm to maintain registration between the surfaces of the plate cylinder and form roller;

wherein the diameters and speed of rotation of the plate cylinder and form roller are selected to produce a difference in surface speed at the nip formed between the plate cylinder and the form roller greater than one foot per minute while simultaneously maintaining registration of surface areas of the plate cylinder and form roller.

18. The method of claim 17 further comprising:

subtracting ink from the surface of the form roller after it contacts the plate cylinder.

* * * * *